US007905572B2

(12) United States Patent
Anderson, Jr. et al.

(10) Patent No.: US 7,905,572 B2
(45) Date of Patent: Mar. 15, 2011

(54) APPARATUS FOR MOUNTING A REMOVABLE INK TANK IN AN IMAGING APPARATUS

(75) Inventors: James Daniel Anderson, Jr., Harrodsburg, KY (US); David Emerson Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 872 days.

(21) Appl. No.: 11/419,040

(22) Filed: May 18, 2006

(65) Prior Publication Data

US 2007/0268344 A1 Nov. 22, 2007

(51) Int. Cl.
*B41J 2/14* (2006.01)

(52) U.S. Cl. ..... 347/49

(58) Field of Classification Search ..... 347/37, 347/49, 85, 86, 87, 93
See application file for complete search history.

(56) References Cited

U.S. PATENT DOCUMENTS

| | | | | |
|---|---|---|---|---|
| 5,552,816 | A * | 9/1996 | Oda et al. | 347/86 |
| 5,886,721 | A * | 3/1999 | Fujii et al. | 347/87 |
| 5,905,518 | A * | 5/1999 | DeFilippis | 347/85 |
| 6,019,465 | A * | 2/2000 | Shinada et al. | 347/93 |
| 6,027,209 | A * | 2/2000 | Menendez et al. | 347/85 |
| 6,199,977 | B1 * | 3/2001 | Komplin et al. | 347/86 |
| 6,766,817 | B2 | 7/2004 | da Silva | |
| 6,918,404 | B2 | 7/2005 | Dias da Silva | |
| 7,066,586 | B2 | 6/2006 | da Silva | |
| 7,285,255 | B2 | 10/2007 | Kadlec et al. | |
| 2007/0268344 | A1 | 11/2007 | Anderson et al. | |

* cited by examiner

*Primary Examiner* — Anh T. N. Vo
(74) *Attorney, Agent, or Firm* — Taylor & Aust, PC

(57) ABSTRACT

An apparatus for mounting a removable ink tank having an ink output port to a printhead body that mounts a micro-fluid ejection device, the printhead body defining a filtered ink/air reservoir, includes a filter cap configured for attachment to the printhead body. The filtered ink/air reservoir is located in a region between the filter cap and the micro-fluid ejection device. The filter cap has a filter cap body configured to operably engage the ink output port of the removable ink tank and has an ink tank latching mechanism configured to secure the removable ink tank to the filter cap in a releasable manner.

12 Claims, 7 Drawing Sheets

APPARATUS FOR MOUNTING A REMOVABLE INK TANK IN AN IMAGING APPARATUS

FIELD OF THE INVENTION

The present invention relates to an imaging apparatus, and, more particularly, to an apparatus for mounting a removable ink tank in an imaging apparatus.

BACKGROUND OF THE INVENTION

An imaging apparatus, such as an ink jet printer, forms an image on a print medium, such as paper, by applying ink to the print medium. The ink may be contained in one or more replaceable supply cartridges. Examples of such replaceable supply cartridges include a replaceable ink tank and an ink jet printhead cartridge. An ink jet printhead cartridge, for example, includes both an ink tank and an ink jet micro-fluid ejection device, whereas an ink tank does not include the micro-fluid ejection device.

One such ink jet printer mounts a plurality of ink tanks, with each ink tank containing a supply of a particular color of ink, e.g., black, cyan, magenta, and yellow. Each ink tank is mounted to a micro-fluid ejection device that is separately mounted to the printhead carrier, and is commonly referred to as an on-carrier ink tank system. In an on-carrier ink tank system, the ink is transferred from the tank to the micro-fluid ejection device through as series of fluid interfaces. The ink typically is suspended in the tank in a felt or foam. Care must be taken to ensure firm mounting of each removable ink tank in relation to the printhead assembly, so as to, for example, facilitate the formation of an adequate seal between each ink tank and the printhead assembly at the fluid interface.

SUMMARY OF THE INVENTION

The present invention provides an apparatus for mounting a removable ink tank in an imaging apparatus, such as for example, an ink jet printer.

The invention, in one form thereof, is directed to an apparatus for mounting a removable ink tank having an ink output port to a printhead body that mounts a micro-fluid ejection device, the printhead body defining a filtered ink/air reservoir. The apparatus includes a filter cap configured for attachment to the printhead body. The filtered ink/air reservoir is located in a region between the filter cap and the micro-fluid ejection device. The filter cap has a filter cap body configured to operably engage the ink output port of the removable ink tank and has an ink tank latching mechanism configured to secure the removable ink tank to the filter cap in a releasable manner.

The invention, in another form thereof, is directed to an imaging apparatus configured for mounting a removable ink tank having an ink output port. The imaging apparatus includes a printhead carrier configured for reciprocating motion along a main scan axis. A printhead body is mounted to the printhead carrier. The printhead body defines a filtered ink/air reservoir. A micro-fluid ejection device is attached to the printhead body. A filter cap is attached to the printhead body. The filtered ink/air reservoir is located in a region between the filter cap and the micro-fluid ejection device. The filter cap has a filter cap body configured to operably engage the ink output port of the removable ink tank and has an ink tank latching mechanism configured to secure the removable ink tank to the filter cap in a releasable manner.

The invention, in another form thereof, is directed to a removable ink tank configured to be mounted to a printhead carrier of an imaging apparatus, wherein a printhead body having a micro-fluid ejection device is mounted to the printhead carrier, the printhead body defining a filtered ink/air reservoir and having a filter cap attached to the printhead body, the filtered ink/air reservoir being located in a region between the fiber cap and the micro-fluid ejection device, the filter cap having a filter cap body and an ink tank latching mechanism. The removable ink tank includes a base configured with an ink output port. A side wall structure has a bottom end and a top end opposite to the bottom end, the bottom end being attached to the base, and has a front wall and a rear wall opposite to the front wall. A cover is attached to the top end of the side wall structure. A latching tab extends outwardly from a first region of the removable ink tank near an intersection of the cover and the top end of the side wall structure along the front wall. The latching tab is positioned to engage the ink tank latching mechanism of the filter cap. A rib extends outwardly from a second region of the removable ink tank near an intersection of the base and the bottom end of the side wall structure along the rear wall. The rib is located to engage a portion of the printhead carrier.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DESCRIPTION OF THE PREFERRED EMBODIMENT

Figure 1:
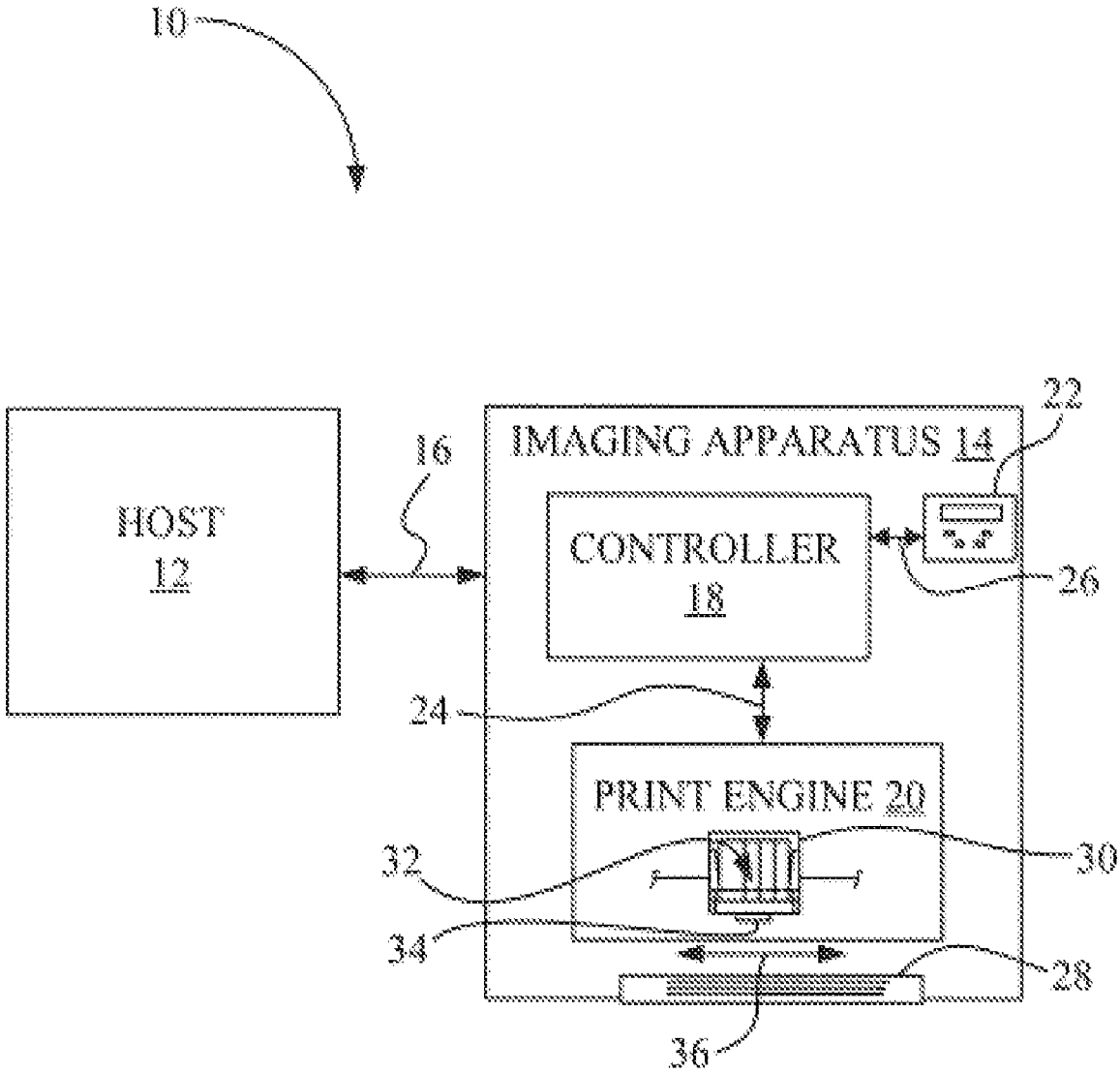
FIG. 1 is a diagrammatic depiction of an imaging system embodying the present invention.

Referring to FIG. 1, there is shown a diagrammatic depiction of an imaging system 10 embodying the present invention. Imaging system 10 may include a host 12 and an imaging apparatus 14. Imaging apparatus 14 communicates with host 12 via a communications link 16. Communications link 16 may be established by a direct cable connection, wireless connection or by a network connection such as for example an Ethernet local area network (LAN).

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation host 12 may include in its memory a software program including program instructions that function as an imaging driver, e.g., printer driver software, for imaging apparatus 14. Alternatively, the imaging driver may be incorporated, in whole or in part, an imaging apparatus 14.

In the embodiment of FIG. 1, imaging apparatus 14 includes a controller 18, a print engine 20 and a user interface 22.

Host 12 is in communication with controller 18 of imaging apparatus 14 via communications link 16. The imaging device facilitates communication between imaging apparatus 14 and host 12, and may provide formatted print data to imaging apparatus 14, and more particularly, to print engine 20. Alternatively, however, all or a portion of the imaging driver may be located in controller 18 of imaging apparatus 14. For example, where imaging apparatus 14 is a multifunction machine having standalone capabilities, controller 18 of imaging apparatus 14 may include the imaging driver configured to support a copying function, and/or a fax-print function, and may be further configured to support a printer function.

Controller 18 includes a processor unit and associated memory, and may be formed as an Application Specific Integrated Circuit (ASIC). Controller 18 communicates with print engine 20 via a communications link 24. Controller 18 communicates with user interface 22 via a communications link 26. Communications link 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric.

Figure 2A:
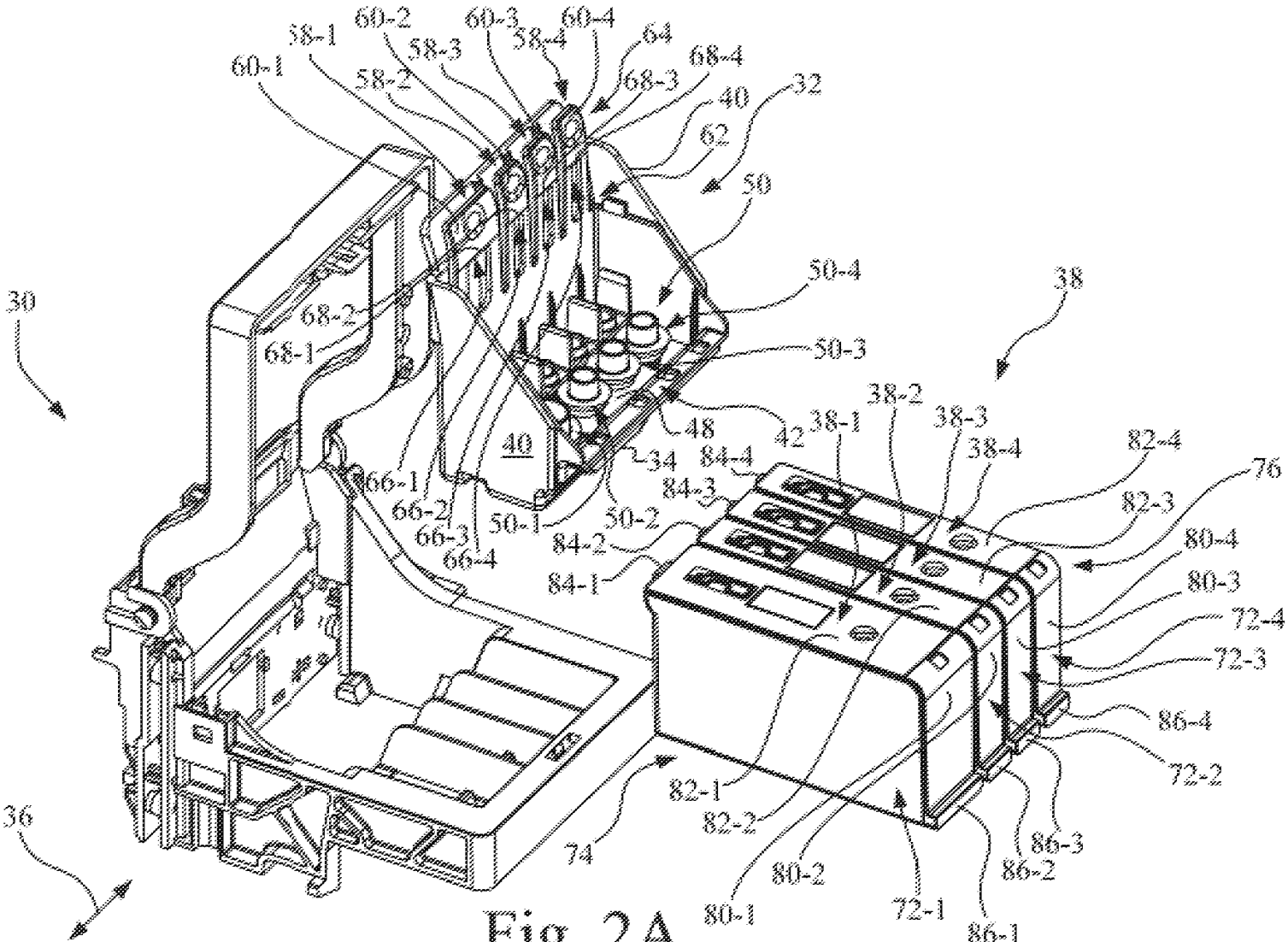
FIG. 2A is a perspective view of the printhead carrier of FIG. 1, with the printhead assembly and ink tanks removed.
Figure 3:
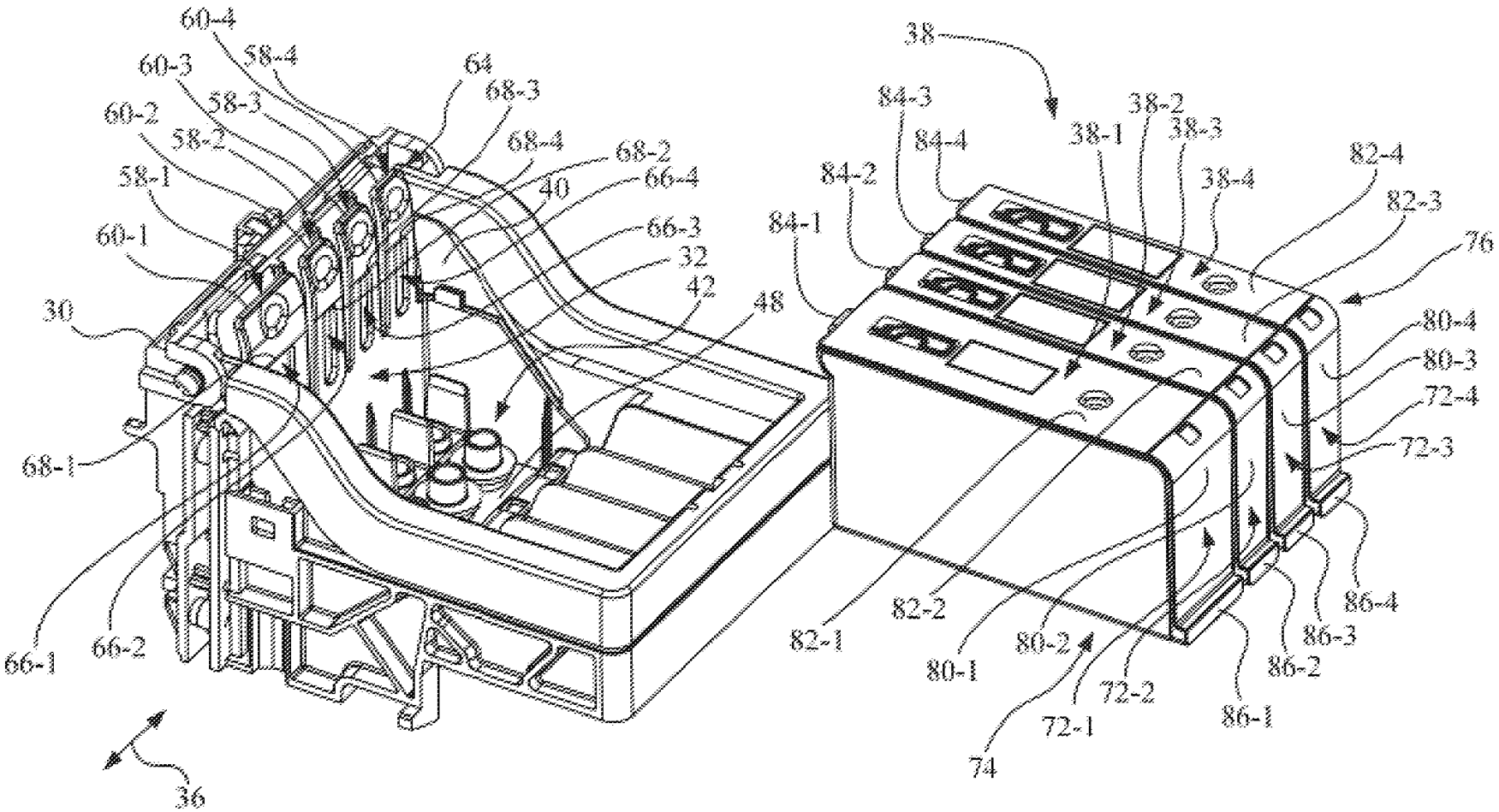
FIG. 3 is a perspective view of the printhead carrier of FIG. 1 with the printhead assembly installed.

Print engine 20 may include, for example, a reciprocating printhead carrier 30. Referring now also to FIGS. 2A and 3, a printhead carrier 30 is mechanically and electrically configured to mount and carry at least one printhead assembly 32 that includes at least one ink jet micro-fluid ejection device 34. Printhead carrier 30 transports printhead assembly 32, and in turn ink jet micro-fluid ejection device 34, in a reciprocating manner in a bi-directional main scan direction, i.e., axis, 36 over an image surface of the sheet of print media 28 during a printing operation.

Printhead assembly 32 is configured to mount and carry a plurality of removable ink tanks 38, and to facilitate an ink transfer from one or more of the plurality of ink tanks 38 to micro-fluid ejection device 34. The plurality of ink tanks 38 may include, as in the example of FIGS. 1, 2A, and 3, a monochrome ink tank 38-1, e.g., containing black ink, and three color ink tanks 38-2, 38-3, 38-4, e.g., containing cyan, magenta, and yellow inks. Micro-fluid ejection device 34 may include an ink jet nozzle array for each color of ink.

Figure 4:
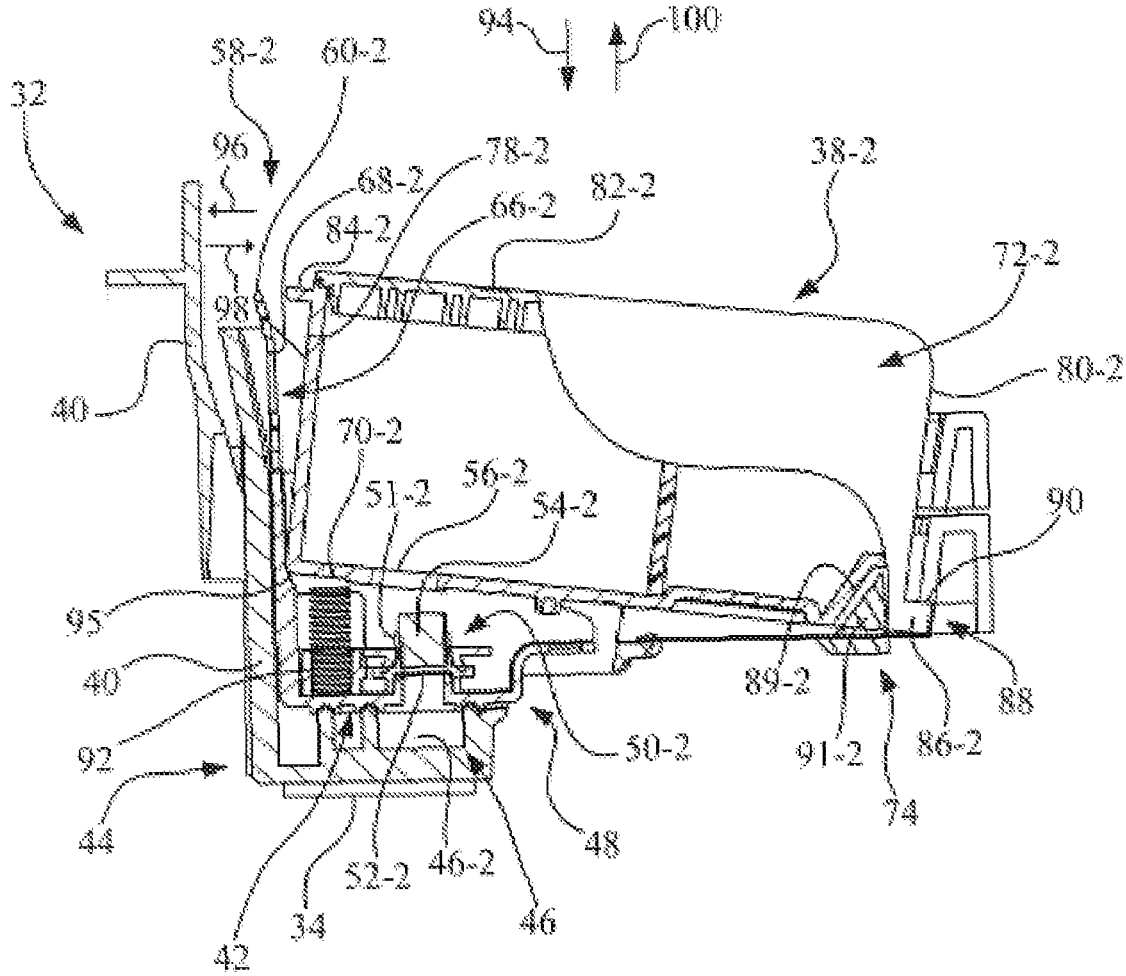
FIG. 4 is a side partial section view of the printhead assembly and a color ink tank, with a portion broken away, and with the ink tank partially installed in the printhead assembly.

As best shown in FIGS. 2A and 4, printhead assembly 32 includes a printhead body 40 and a filter cap 42. Micro-fluid ejection device 34 is attached to a snout portion 44 of printhead body 40. Printhead body 40 is configured to define individual filtered ink/air reservoirs 46 that are in fluid communication with micro-fluid ejection device 34. Filter cap 42 is attached to printhead body 40 via a hermetic seal, such as by welding or adhesive attachment. Each filtered ink/air reservoir 46 is located in a region between filter cap 42 and micro-fluid ejection device 34. Each filtered ink/air reservoir 46, for example, stores air that is ingested during printing.

Referring to FIGS. 2A, 3 and 4, filter cap 42 has a filter cap body 48 configured with a plurality of fluid interface devices 50, individually identified as fluid interface device 50-1, fluid interface device 50-2, fluid interface device 50-3, and fluid interface device 50-4 that operably engages and facilitates fluid communication with the respective ink output ports of ink tanks 38-1, 38-2, 38-3 and 38-4, respectively.

Figure 2B:
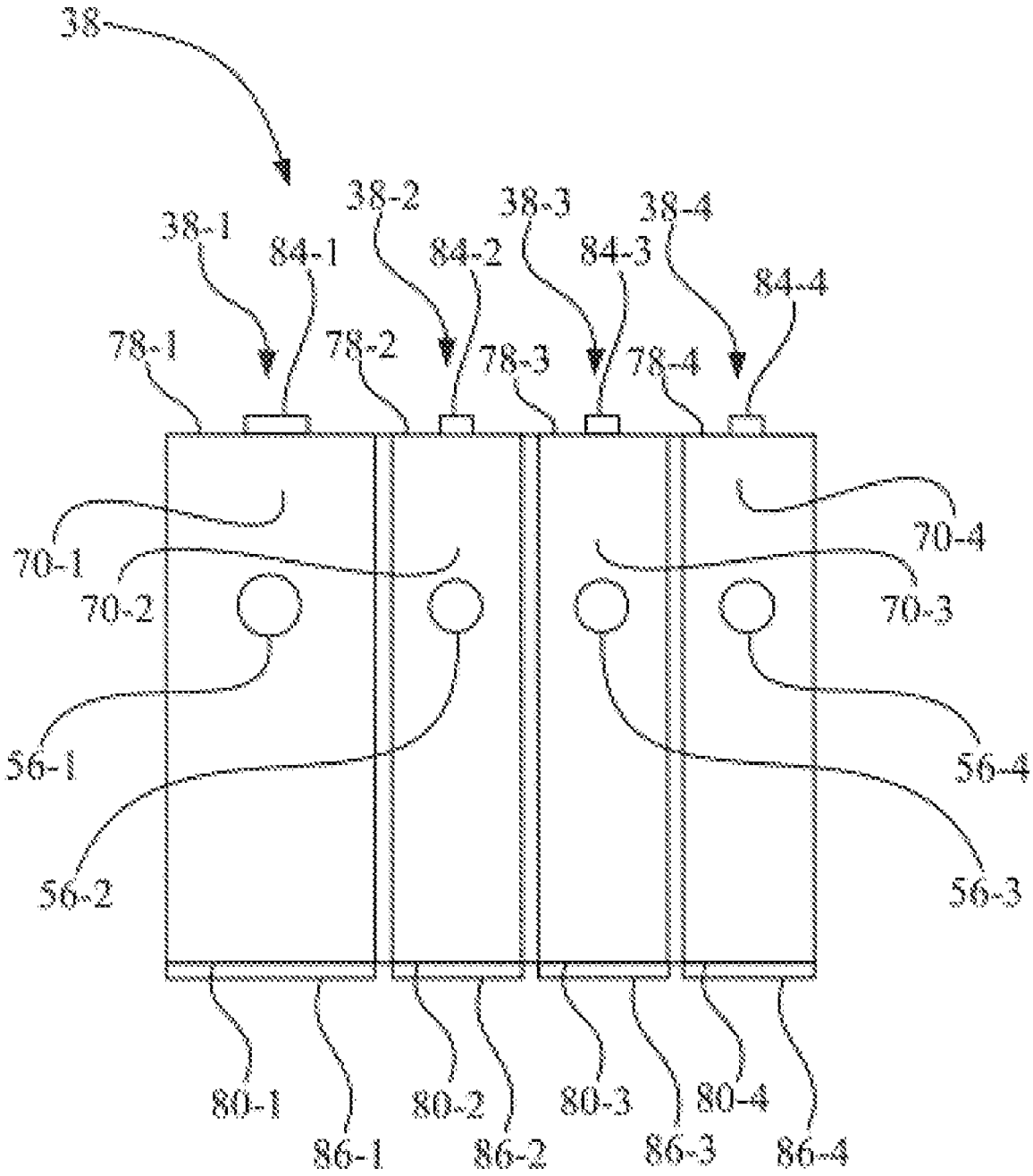
FIG. 2B is a bottom view of the ink tanks of FIG. 2A.

As shown, for example, in FIG. 4 including color ink tank 38-2, fluid interface device 50-2 includes a standpipe 51-2 in fluid communication with filtered ink/air reservoir 46-2 via a filter 52-2, and carries a wick 54-2. Referring to FIG. 2B, ink tanks 38-1, 38-2, 38-3 and 38-4 include a respective ink output port 56-1, 56-2, 56-3 and 56-4. Wick 54-2, for example, facilitates fluid communication with ink output port 56-2 of ink tank 38-2. For example, the ink in ink tank 38-2 is suspended in a felt or foam, and is transferred to wick 54-2 when wick 54-2 contacts the felt, or foam, contained in ink tank 38-2. Also, wick 54-2 is in fluid communication with filter 52-2. Filter 52-2 acts as the seal for filtered ink/air reservoir 46-2 above the via of the chip forming a portion of micro-fluid ejection device 34. Each of the plurality of fluid interface devices 50 and the plurality of ink tanks 38 is similarly configured as described above with respect to fluid interface device 50-2 and ink tank 38-2.

Referring to FIGS. 2A and 3, filter cap 42 further includes ink tank latching mechanisms 58-1, 58-2, 58-3 and 58-4 configured to secure, in a releasable manner, the respective removable ink tanks 38-1, 38-2, 38-3, and 38-4 to filter cap 42, and in turn, to printhead assembly 32 and printhead carrier 30. Each of ink tank latching mechanisms 58-1, 58-2, 58-3 and 58-4 includes a respective of cantilever arm 60-1, 60-2, 60-3, and 60-4 that has a proximal end 62 and a distal end 64. Proximal end 62 of each cantilever arm is attached to filter cap body 48 of filter cap 42. Distal end 64 is the free end of individual cantilever arms 60-1, 60-2, 60-3, and 60-4. Distal end 64 of each of cantilever arms 60-1, 60-2, 60-3, and 60-4 has a respective latch feature 66-1, 66-2, 66-3, 66-4, which in this embodiment is in the form of an opening defining a respective latch surface 68-1, 68-2, 68-3 and 68-4 for engaging a portion of the respective removable ink tanks 38-1, 38-2, 38-3, and 38-4.

Referring to FIGS. 2A, 2B and 3, ink tank 38-1 includes a base 70-1 configured with ink output port 56-1. Ink tank 38-1 also includes a side wall structure 72-1 having a bottom end 74 and a top end 76 opposite to the bottom end 74. Bottom end 74 of side wall structure 72-1 is attached to base 70-1. Side wall structure 72-1 includes a front wall 78-1 and a rear wall 80-1 opposite to front wall 78-1. A cover 82-1 is attached to the top end 76 of side wall structure 72-1. A latching tab 84-1 extends outwardly from a region of the removable ink tank near an intersection of the cover 82-1 and the top end 76 of side wall structure 72-1 along front wall 78-1. Latching tab 84-1 is positioned to engage ink tank latching mechanism 58-1 of filter cap 42. A rib 86-1 extends outwardly from a region of the removable ink tank near an intersection of base 70-1 and the bottom end 74 of side wall structure 72-1 along rear wall 80-1. Rib 86-1 may be formed integral with ink tank 38-1, or may formed as part of a façade attached to ink tank 38-1, but in either case is considered to be a part of ink tank 38-1. Rib 86-1 is located to engage a portion of the printhead carrier 30. Rib 86-1 may be formed, for example, as a key member having a shape or location that distinguishes one type of ink tank from another type of ink tank. The term "type"

refers to, for example, the color of ink and/or the composition of the ink contained in the ink tank.

Ink tank 38-2 includes a base 70-2 configured with ink output port 56-2. Ink tank 38-2 includes a side wall structure 72-2 having bottom end 74 and top end 76 opposite to the bottom end 74. Bottom end 74 of side wall structure 72-2 is attached to base 70-2. Side wall structure 72-2 includes a front wall 78-2 and a rear wall 80-2 opposite to front wall 78-2. A cover 82-2 is attached to the top end 76 of side wall structure 72-2. A latching tab 84-2 extends outwardly from a region of the removable ink tank near an intersection of the cover 82-2 and the top end 76 of side wall structure 72-2 along front wall 78-2. Latching tab 84-2 is positioned to engage ink tank latching mechanism 58-2 of filter cap 42. A rib 86-2 extends outwardly from a region of the removable ink tank near an intersection of base 70-2 and the bottom end 74 of side wall structure 72-2 along rear wall 80-2. Rib 86-2 may be formed integral with ink tank 38-2, or may formed as part of a façade attached to ink tank 38-2, but in either case is considered to be part of ink tank 38-2. Rib 86-2 is located to engage a portion of the printhead carrier 30. Rib 86-2 may be formed, for example, as a key member that distinguishes one type of ink tank from another type of ink tank.

Ink tank 38-3 includes a base 70-3 configured with ink output port 56-3. Ink tank 38-3 includes a side wall structure 72-3 having bottom end 74 and top end 76 opposite to the bottom end 74. Bottom end 74 of side wall structure 72-3 is attached to base 70-3. Side wall structure 72-3 includes a front wall 78-3 and a rear wall 80-3 opposite to front wall 78-3. A cover 82-3 is attached to the top end 76 of side wall structure 72-3. A latching tab 84-3 extends outwardly from a region of the removable ink tank near an intersection of the cover 82-3 and the top end 76 of side wall structure 72-3 along front wall 78-3. Latching tab 84-3 is positioned to engage ink tank latching mechanism 58-3 of filter cap 42. A rib 86-3 extends outwardly from a region of the removable ink tank near an intersection of base 70-3 and the bottom end 74 of side wall structure 72-3 along rear wall 80-3. Rib 86-3 may be formed integral with ink tank 38-3, or may formed as part of a façade attached to ink tank 38-3, but in either case is considered to be a part of ink tank 38-3. Rib 86-3 is located to engage a portion of the printhead carrier 30. Rib 86-3 may be formed, for example, as a key member that distinguishes one type of ink tank from another type of ink tank.

Ink tank 38-4 includes a base 70-4 configured with ink output port 56-4. Ink tank 38-4 includes a side wall structure 72-4 having bottom end 74 and top end 76 opposite to the bottom end 74. Bottom end 74 of side wall structure 72-4 is attached to base 70-4. Side wall structure 72-4 includes a front wall 78-4 and a rear wall 80-4 opposite to front wall 78-4. A cover 82-4 is attached to the top end 76 of side wall structure 72-4. A latching tab 84-4 extends outwardly from a region of the removable ink tank near an intersection of the cover 82-4 and the top end 76 of side wall structure 72-4 along front wall 78-4. Latching tab 84-4 is positioned to engage ink tank latching mechanism 58-4 of filter cap 42. A rib 86-4 extends outwardly from a region of the removable ink tank near an intersection of base 70-4 and the bottom end 74 of side wall structure 72-4 along rear wall 80-4. Rib 86-4 may be formed integral with ink tank 38-4, or may formed as part of a façade attached to ink tank 38-4, but in either case is considered to be a part of ink tank 38-4. Rib 86-4 is located to engage a portion of the printhead carrier 30. Rib 86-4 may be formed, for example, as a key member that distinguishes one type of ink tank from another type of ink tank.

As can be best seen in FIG. 4, printhead carrier 30 includes a pivot mechanism 88 positioned to engage and receive each of the ribs 86-1, 86-2, 86-3 and 86-4 of ink tanks 38-1, 38-2, 38-3, and 38-4, respectively. Pivot mechanism 88 may be configured with a slot 90 defining a keying feature to selectively receive only a specific ink tank having a proper key member corresponding to the keying feature at a particular location within printhead carrier 30. For example, each of ribs 86-1, 86-2, 86-3 and 86-4 may have a unique shape to serve as a respective key member, and the shape of the slot 90 of pivot mechanism 88 may be defined to only accommodate ink tanks 38-1, 38-2, 38-3, and 38-4 in a particular sequence across the width of printhead assembly 32.

Alternatively, each of ink tanks 38-1, 38-2, 38-3, and 38-4 may have a key pocket, such as key pocket 89-2 shown in FIG. 4 near an intersection of base 70-2 and the bottom end 74 of side wall structure 72-2 along rear wall 80-2. Likewise, printhead carrier 30 may include a corresponding number of upwardly extending key protrusions, such as key protrusion 91-2 shown in FIG. 4, each of which being configured to be selectively received only by a corresponding one of the key pockets of ink tanks 38-1, 38-2, 38-3, and 38-4.

Figure 5:
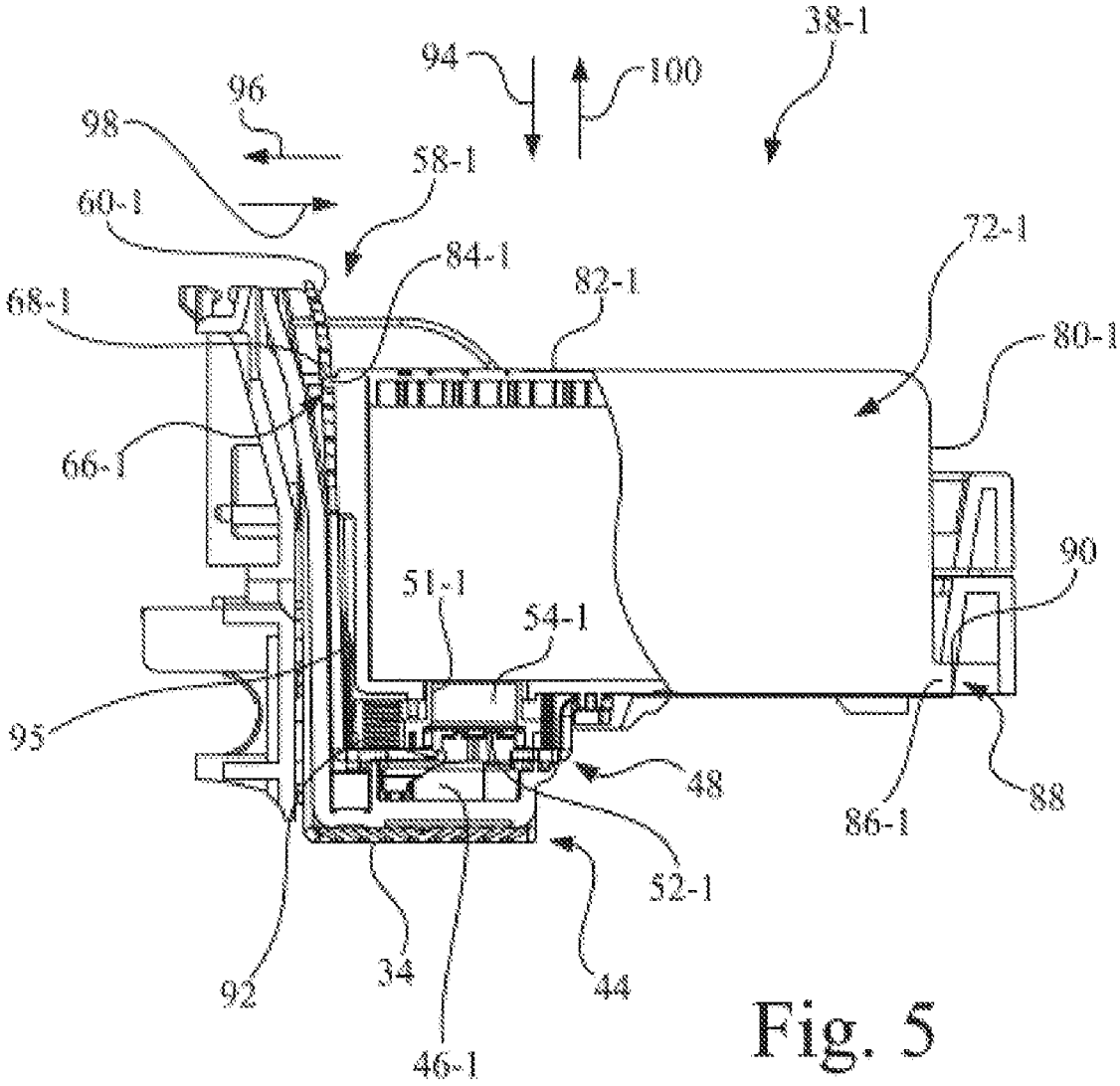
FIG. 5 is a side partial section view of the printhead assembly and a monochrome ink tank, with a portion broken away, and with the ink tank fully installed in the printhead assembly.

FIGS. 4 and 5 illustrate an ink tank loading sequence using ink tanks 38-1 and 38-2 as example.

Referring now to FIG. 4, using color ink tank 38-2 as the example, as ink tank 38-2 is installed in printhead assembly 32, rib 86-2 located in a lower portion of rear wall 80-2 of ink tank 38-2 is inserted into slot 90 of pivot mechanism 88 of printhead carrier 30. At this stage, base 70-2 of ink tank 38-2 engages an associated spring 92 extending upwardly from the floor of filter cap 42. This process is similar for each of the color ink tanks 38-2, 38-3, 38-4, and monochrome ink tank 38-1.

As shown in FIG. 5, using monochrome ink tank 38-1 as the example, during ink tank mounting the user presses downwardly on cover 82-1 of ink tank 38-1 in direction 94 toward the filter cap body 48 of filter cap 42, and in turn pivots ink tank 38-2 downwardly about pivot mechanism 88 of printhead carrier 30, while compressing the associated spring 92, and deflecting cantilever arm 60-1 in direction 96. An ink tank 38-1 moves downward in direction 94, the apex of the front wall 78-1 and base 70-1 of ink tank 38-1 contacts a ramp feature 95 in the front of filter cap 42, which causes ink tank 38-1 to slide rearward, to move and firmly seat rib 86-1 of rear wall 80-1 of ink tank 38-1 into slot 90 of pivot mechanism 88 of printhead carrier 30. The sliding action occurs before wick 54-1 contacts ink tank 38-1 so that wick 54-1 does not roll over. The front wall 78-1 of ink tank 38-1 slides along the rib feature provided by cantilever arm 60-1 as ink tank 38-1 is inserted. This causes ink tank 38-1 to have a mostly vertical motion in direction 94 (e.g., perpendicular to the upper surface of wick 54-1) as ink tank 38-1 comes into contact with wick 54-1. This reduces any scrubbing action of ink tank 38-1 against wick 54-1 and reduces the possibility of wick 54-1 buckling and deforming.

When ink tank 38-1 is pushed in direction 94 a sufficient distance for latching tab 84-1 extending outwardly from an upper portion of front wall 78 of ink tank 38-1 to engage the opening of latch feature 66-1, cantilever arm 60-1 springs back in direction 98. In turn, latching tab 84-1 of ink tank 38-1 is received in the opening of latch feature 66-1. When the pressure exerted in direction 94 is relieved, the associated spring 92 supplies an upward force in direction 100, wherein latching tab 84-1 firmly engages latch surface 68-1 of latch feature 66-1, and ink tank 38-1 is latched in the installed position.

This process described above with respect to FIG. 5 is similar for each of monochrome ink tank 38-1 and color ink tanks 38-2, 38-3, 38-4.

Figure 6:
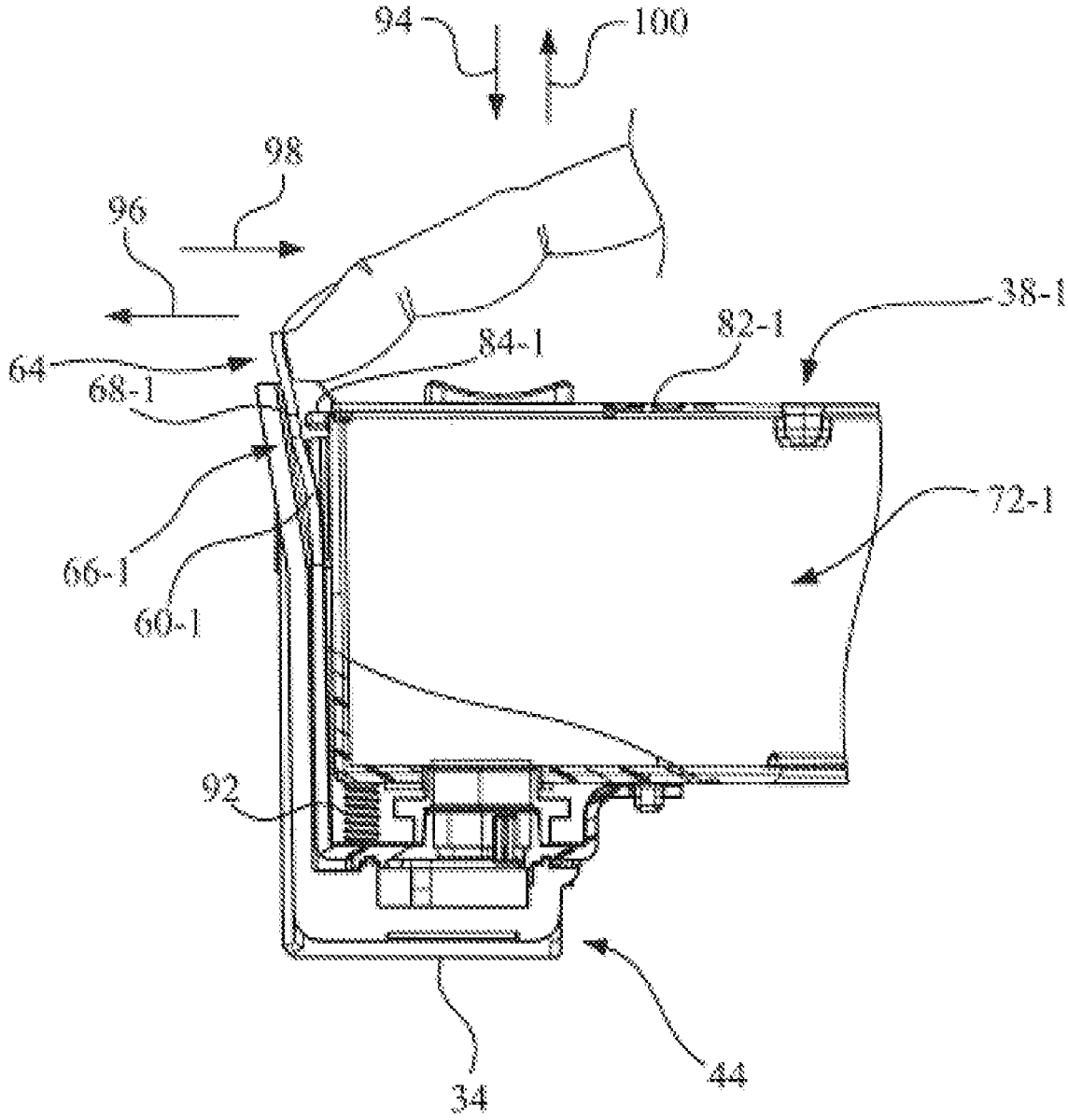
FIG. 6 is a side partial section view of a printhead assembly and an ink tank, illustrating removal of the ink tank from the printhead assembly.

FIG. 6 illustrates the removal of an ink tank, with ink tank 38-1 being used as an example. This process described with respect to FIG. 6 is similar for each of monochrome ink tank 38-1 and color ink tanks 38-2, 38-3, 38-4.

To remove ink tank 38-1, the user applies a force in direction 96 to the distal end 64 of cantilever arm 60-1, until latching tab 84-1 of ink tank 38-1 is no longer engaged with the opening of latch feature 66-1 of cantilever arm 60-1. At this time, the associated spring 92 causes a displacement of the front end of ink tank 38-1 in direction 100 to the position illustrated in FIG. 4, whereby exposing at least a portion of the sidewall structure 72-1 of ink tank 38-1. The exposed portion of the sidewall structure 72-1 of ink tank 38-1 then may be grasped by a user to rotate ink tank 38-1 out of printhead carrier 30.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. An apparatus for mounting a removable ink tank having an ink output port to a printhead body that mounts a micro-fluid ejection device, said printhead body defining a filtered ink/air reservoir, said apparatus comprising a filter cap configured for attachment to said printhead body, said filtered ink/air reservoir being located in a region between said filter cap and said micro-fluid ejection device, said filter cap having a filter cap body configured to operably engage said ink output port of said removable ink tank and having an ink tank latching mechanism configured to secure said removable ink tank to said filter cap in a releasable manner, wherein said ink tank latching mechanism is a cantilever arm, said cantilever arm having a proximal end and a distal end, said proximal end being attached to said filter cap body and said distal end having a latch feature for engaging a portion of said removable ink tank.

2. The apparatus of claim 1, wherein said latch feature is an opening, and said portion of said removable ink tank is an outwardly extending tab.

3. An imaging apparaus configured for mounting a removable ink tank having an ink output port, comprising:

a printhead carrier configured for reciprocating motion along a main scan axis;

a printhead body mounted to said printhead carrier, said printhead body defining a filtered ink/air reservoir;

a micro-fluid ejection device attached to said printhead body; and a filter cap attached to said printhead body, said filtered ink/air reservoir being located in a region between said filter cap and said micro-fluid ejection device, said filter cap having a filter cap body configured to operably engage said ink output port of said removable ink tank and having an ink tank latching mechanism configured to secure said removable ink tank to said filter cap in a releasable manner, wherein said ink tank latching mechanism is a cantilever arm, said cantilever arm having a proximal end and a distal end, said proximal end being attached to said filter cap body and said distal end having a latch feature for engaging a first portion of said removable ink tank.

4. The imaging apparatus of claim 3, wherein said latch feature is an opening, and said first portion of said removable ink tank is an outwardly extending tab.

5. The imaging apparatus of claim 3 said carrier including a pivot mechanism positioned to engage a second portion of said removable ink tank.

6. The imaging apparatus of claim 5, said filter cap having a ramped feature positioned to be engaged by said removable ink tank during ink tank installation to cause said second portion of said removable ink tank to be moved into a slot of said pivot mechanism.

7. The imaging apparatus of claim 5, wherein said pivot mechanism is configured to include a keying feature to selectively receive only a specific ink tank having a proper key member corresponding to said keying feature.

8. The imaging apparatus of claim 5, further comprising a key pocket formed in a base of said ink tank near said second portion, and said printhead carrier having key protursion configured to be selectively received only by said key pocket.

9. A removable ink tank configured to be mounted to a printhead carrier of an imaging apparatus, wherein a printhead body having a micro-fluid ejection device is mounted to said printhead carrier, said printhead body defining a filtered ink/air reservoir and having a filter cap attached to said printhead body, said filtered ink/air reservoir being located in a region between said filter cap and said micro-fluid ejection device, said filter cap having a filter cap body and an ink tank latching mechanism, said removable ink tank comprising:

a base configured with an ink output port;

a side wall structure having a bottom end and a top end opposite to said bottom end, said bottom end being attached to said base, and having a front wall and a rear wall opposite to said front wall;

a cover attached to said top end of said side wall structure;

a latching tab extending outwardly from a first region of said removable ink tank near an intersection of said cover and said top end of said side wall structure along said front wall, said latching tab being positioned to engage said ink tank latching mechanism of said filter cap; and a rib extending outwardly from a second region of said removable ink tank near an intersection of said base and said bottom end of said side wall structure along said rear wall, said rib being located to engage a portion of said printhead carrier.

10. The removable ink tank of claim 9, wherein said rib is formed as a key member.

11. The removable ink tank of claim 9, further comprising a key pocket formed in a base of said ink tank.

12. The removable ink tank of claim 11, wherein said key pocket is formed in said base near said rear wall.

* * * * *